US005937948A

United States Patent [19]

Robbins, III

[11] Patent Number: 5,937,948

[45] Date of Patent: Aug. 17, 1999

[54] EXTRUDED CASING CENTRALIZER

[76] Inventor: George Dee Robbins, III, 213 Amberwood Dr., Youngsville, La. 70592

[21] Appl. No.: 09/007,634

[22] Filed: Jan. 15, 1998

[51] Int. Cl.[6] ..... E21B 19/16; E21B 17/10

[52] U.S. Cl. ..... 166/380; 166/241.6; 175/76; 175/325.5

[58] Field of Search ..... 166/378, 380, 166/241.1, 241.6; 175/76, 323, 325.1, 325.5

[56] References Cited

U.S. PATENT DOCUMENTS 4,606,417 8/1986 Webb et al. ..... 175/325.3 X
4,938,299 7/1990 Jelsma ..... 175/325.2 X

*Primary Examiner*—Roger Schoeppel
*Attorney, Agent, or Firm*—Jesse D. Lambert

[57] ABSTRACT

An integrally formed, solid casing centralizer for centering casing strings in oil and gas wells. The casing centralizer includes a central body having a bore adapted to closely engage a casing string and a plurality of integral blades radiating outwardly from the central body. The centralizer is formed by heating a billet of suitable metal to a temperature sufficient to render the billet malleable for extrusion yet which is substantially below a melting temperature of the billet, forcing the metal through a die, thereby forming a workpiece having a profile suitable to form a desired cross-sectional shape of a casing centralizer; cooling the extruded workpiece, and cutting the cooled, extruded workpiece into sections, each section having a length sufficient to form a casing centralizer. Each end of each blade may be bevelled to ease passage of the centralizer into the wellbore, and lock screws may be provided in threaded holes penetrating the central body and blades to fix the centralizers at desired locations on a casing string. The present invention results in an extruded solid casing centralizer substantially free of gas inclusions in the metal, resulting in high strength with minimum dimensions and thereby retaining maximum annular flow area. The extruded centralizer, without further finish work, typically has an overall surface finish RMS value of approximately 125 micro inches.

19 Claims, 4 Drawing Sheets

EXTRUDED CASING CENTRALIZER

BACKGROUND—FIELD OF THE INVENTION

The subject invention relates generally to downhole equipment used in the drilling and completion of oil and gas wells, and more particularly to apparatus, commonly called "centralizers", which are used to hold a downhole tubular string, especially casing strings, centered inside an earthen borehole or inside a somewhat larger string of tubular goods.

BACKGROUND—DESCRIPTION OF RELATED ART

During the course of drilling oil and gas wells, various tubular goods are placed downhole to form the well. In particular, at usually several depths over the course of drilling a well, casing strings are run downhole and cemented in place. A typical sequence of well drilling includes successive stages of drilling an "open hole" section below an existing casing string, running a casing string through the existing, larger casing string to near the bottom of the open hole section or "borehole", then cementing the casing string in place. Drilling of the next open hole section then proceeds through the just-run casing string, with a drill bit having a diameter somewhat smaller than the inner diameter of the previous casing string.

This sequence of running and cementing of casing strings is necessary to support the walls of the borehole as drilling progresses deeper, and to isolate shallower, weaker formations from deeper, higher pressure formations. After each casing string is in place, a cement slurry is pumped down through the casing and into the annulus between the outside of the casing and the wall of the borehole. Once the cement slurry fills the annulus, pumping is discontinued and the cement is allowed to harden. The hardened cement supports the casing and protects it from the corrosive effects of some formation fluids, particularly formation brines or "salt water", and also from corrosive treating fluids such as acids and the like.

The cement sheath also serves the critically important function of forming a "cement bond" or hydraulic seal between the wall of the borehole and the casing, thereby preventing migration of fluids through the casing/borehole annulus from one zone to another due to pressure differentials. Such hydraulic seal is necessary to prevent potential "well control" problems (in the nature of underground blowouts, where high pressure fluids may ultimately travel to the earth's surface), to prevent undesirable flows of hydrocarbons from a zone of one phase into zones of another phase (e.g., gas flowing into an oil zone, thereby reducing ultimate hydrocarbon recovery in both zones), and to prevent pollution from saltwater or hydrocarbon zones from flowing into shallower water zones used as potable water sources.

To form an effective hydraulic seal, the cement must completely fill the casing/borehole annulus and surround the casing. Thus, "centralizers" are commonly fixed to the outside of the casing string, spaced along the length of the casing string, to hold the casing string in a centered position within the borehole and to allow the cement slurry to completely fill the casing/borehole annulus.

A relatively recent drilling procedure involves drilling of "horizontal" wells, which are oil and gas wells in which at least part of the well, typically that part which penetrates productive formations, is at a high angle with respect to vertical, which angle may equal or even exceed 90° from vertical, hence the "horizontal" terminology. The horizontal casing section, often including sections of sand screen, is usually not cemented in place and may be quite long (on the order of thousands of feet), thus requiring a large number of strong centralizers at relatively close spacing to support the casing off of the low side of the borehole. Additionally, high drag forces associated with running casing strings into horizontal wells means that the centralizers employed must be of a shape and surface finish offering the lowest drag forces.

In both conventional and horizontal wells, downhole treatments with caustic and acidic fluids may be employed to enhance production, hence centralizers exposed to such fluids are preferably of a material highly resistant to the corrosive effects of such fluids, such as ferrous alloys. Centralizers must be strong enough to support a significant part of the weight of the casing string without collapsing, especially in a highly deviated or horizontal well. Centralizers must also have high strength and abrasion resistance to withstand the dragging, lateral forces encountered while running in the hole on a casing string. Furthermore, centralizers ideally have a shape which facilitates passage of the centralizer into the borehole, and dimensions, shape, and finish that, particularly when used to centralize sand screen in a producing formation, permits minimal restriction to the passage of fluids. Achieving all of these physical characteristics in a centralizer having the lowest cost possible is desired.

The prior art does not disclose a centralizer that is both optimized to have the desired physical characteristics and may be manufactured at a low cost. For example, one traditional design of casing centralizer comprises two spaced-apart circular bands which clamp around the casing string, with several outwardly bowed springs that are connected (by welding or other like means) at their opposite ends to the two circular bands. Although the resiliency of the bow springs provides for ease of movement through obstructions and changes of contour in the borehole, the springs have limited strength and may collapse under the weight of the casing string, permitting the casing string to rest against the wall of the borehole instead of being centered in the borehole. Such non-centered position is unacceptable in cementing or production applications.

As an alternative to bow spring centralizers prior art also teaches centralization by welding blades of metal to a centralizer which may be installed on the tubular, or to the tubular itself. Such centralizers are expensive to manufacture, are of limited strength and not all tubular goods, particularly grade, high strength, corrosion resistant tubulars may be welded without adverse consequences.

As a response to the limitations of bow spring and welded centralizers, "solid" centralizers were developed. Such centralizers generally comprise a solid tubular body with integrally formed solid blades disposed longitudinally along the outer surface of the tubular body. Prior art teaches that such centralizers may either be machined out of a larger integrally formed block of metal, or cast as integrally formed apparatus. Machining centralizers out of a larger block of integrally formed metal is impractical because of the substantial time, cost and waste apparent in such process.

Casting of metal parts, such as centralizers, comprises melting a quantity of metal and pouring it into a mold which has a shape substantially like that of the finished product. After the metal has cooled and solidified, the piece is removed from the mold either by opening or breaking apart the mold. Because of their shape, sand molds are almost always used to cast at least certain portions of the centralizer.

In one process sand molding is used to cast the entire shape of the centralizer. In another process, a permanent metal mold is used to cast the exterior parts of the centralizer, but are unsuitable to form interior shape because it must be of uniform, non-tapering cross sectional area, and a permanent mold cannot be removed from a non-tapered bore.

Casted centralizers, however casting is done, possess several disadvantages. The casting process inherently often results in various inclusions (e.g., gas bubbles) being present in the cast piece. These inclusions weaken the centralizer, so to offset that effect, extra metal is used—that is, the dimensions of the centralizer are thicker than otherwise needed, to provide sufficient metal to offset the weakening effects of the inclusions. The thicker dimensions result in two detrimental effects: a greater mass of metal is required, increasing costs, and the thicker central body and blades occupy more of the casing/borehole annulus area, thereby decreasing the flow of fluids by the centralizer. Realizing that in any particular application dozens if not hundreds of centralizers may be employed in a particular well, the aggregate flow reduction can be significant.

Further, the surface finish of a casting is rough, requiring costly finishing to smooth, or resulting in undesirable cement flow characteristics if left unsmoothed. The casting process requires that the cross-sectional shape of the centralizer be compromised from that shape which yields an optimum balance of strength, maximum retained annular flow area, and cost, in order to accommodate particular features which the casting process demands. For example, at the junction between the tubular body and a blade, a rounded fillet must be provided to ensure that the mold can be readily removed from the cast piece; in the absence of such a requirement, a sharper, more nearly square-edged corner would be preferred. Another example is in the cross-sectional shape of a centralizer blade. In cast centralizers, the shape is generally tapering to a smaller width in a direction away from the central body, again to ease release of the mold. Improved fluid flow efficiency and lower cost would dictate an essentially straight-sided, or parallel sidewall, blade.

Yet another problem associated with sand casting is disposal of the sand mold upon completion of the casting. The agent used to bind the sand is generally environmentally unfriendly, and disposal problems (and resultant costs) are associated with disposal of the sand mold after casting.

Still another limitation to casting of centralizers arises out of the types of metal alloys that may be used. Generally speaking, high strength alloys that possess the required physical characteristics for casting are relatively expensive.

Prior art does not teach extruded centralizers or extrusion for manufacture of centralizers. Yet as applied to the manufacture of casing centralizers, extrusion provides the advantages of:

- producing a finished casing centralizer substantially free of inclusions, gas bubbles, or other defects, thereby achieving the requisite strength with an overall smaller cross-sectional area;
- producing a finished casing centralizer having a cross-sectional area and profile generally optimized for strength and retention of maximum annular flow area;
- producing a finished casing centralizer having a smooth surface finish, requiring little or no post-manufacture finish work;
- avoiding environmental concerns associated with disposal of sand casting materials;
- the capability of utilizing relatively low cost alloys;
- the capability of producing casing centralizers in longer lengths than is possible with castings, where multiple shorter centralizers must be linked together to form a long unitary centralizer;
- significant cost savings through reduced labor, reduced poundage of metal, and the use of lower unit cost alloys.

SUMMARY OF THE INVENTION

The present invention is a solid casing centralizer produced by extrusion, where the solid casing centralizer includes a sleeve or tubular central body having a bore adapted to fit closely about a casing string, and a plurality of outwardly-radiating blades, integral to the central body, extending generally longitudinally along the outer diameter of the central body.

The integrally formed casing centralizer of the present invention is formed by heating a generally circular in cross section, metal alloy billet to a temperature which renders the billet malleable, or until the billet is in a "plastic" state, yet which is substantially below the melting point of the alloy. The billet is preferably high strength, corrosion resistant metal. The heated metal billet is then forced under pressure, typically created by hydraulic ram, through a die having a profile suitable for forming a desired cross-sectional centralizer shape, in combination with a central mandrel which forms a central bore, thereby forming an elongated workpiece having a cross-sectional shape of the desired centralizer. As the workpiece exits the die, it is cooled. The workpiece may then be cut into centralizers of desired length. Typically either the blade, the body of the centralizer or both are drilled and threaded so the centralizer may be held in place on the casing string by means of set screws or the like. The shoulders of the blades may be machined to form a taper so as to minimize the possibility of the centralizer hanging on a small obstruction in the well bore.

Because the centralizer of the present invention is manufactured by extrusion, the metal used to form the centralizer is not melted, but is only heated until the metal becomes soft enough for extrusion. Softening the metal to such a "plastic" state, as opposed to melting it, eliminates gas bubbles in the extruded product and therefore maintains the integrity and strength of the finished product. A centralizer made of substantially inclusion-free metal retains relatively high strength for given metal mass and dimensions, and generally allows for thinner, more streamlined construction of the centralizer. Such smaller dimensions reduce drag caused by the centralizer as it is moved in and out of the borehole. In addition, the smaller dimensions reduce that portion of the casing/borehole annulus occupied by the centralizer and may increase available flow area by on the order of 25%. The extrusion process, with little or no post-extrusion finish work, provides a smooth surface on the extruded casing centralizer, further improving fluid flow around the centralizer and minimizes drag forces when the centralizer is run in the hole. Other advantages of the extrusion process are that a wide variety of metal alloys, including many of relatively low unit cost, may be beneficially used, and extrusion can be used to manufacture a large number of various lengths of centralizers at a relatively low cost.

Still other advantages and aspects of the extruded centralizer will become apparent to those skilled in the art upon reviewing the following detailed description, the drawings and appended claims.

DESCRIPTION OF THE PREFERRED EMBODIMENT

Although various embodiments of the integrally formed casing centralizer of the present invention are possible, with respect to FIGS. 1 through 7 one embodiment of the present invention is herein described.

Figure 1:
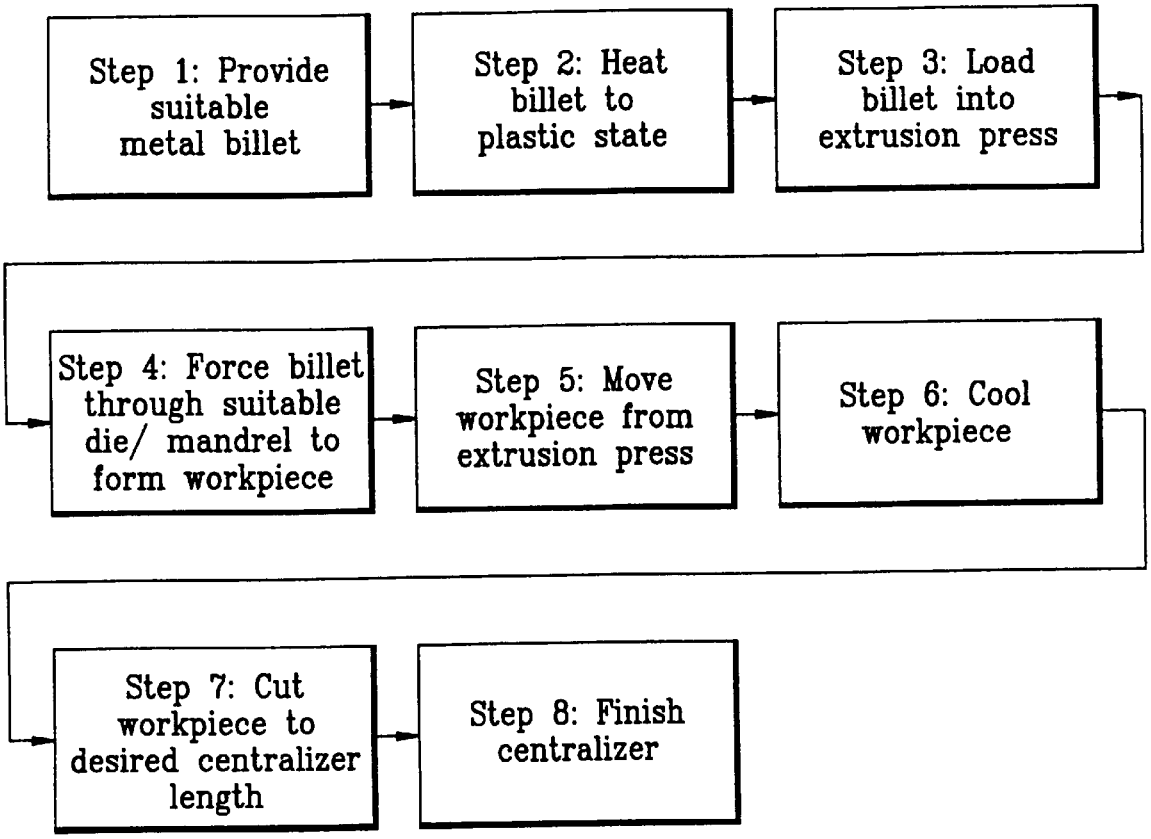
FIG. 1 is a flow chart showing the steps employed in forming the centralizer of the present invention.

FIG. 1 is a schematic of the integrally formed casing centralizer extrusion process. Step 1 comprises providing a volume of suitable metal alloy, typically in the shape of an elongated, circular in cross-section piece called a billet, from which the workpiece (and ultimately the centralizer) is ultimately formed. The billet may be solid or may have a central bore, the bore having a diameter adapted to closely engage the outer surface of a casing string. Preferably, the metal alloy billet has a composition which has high strength, is resistant to most corrosive fluids, is of relatively low unit cost, and has properties which allow it to be readily extruded into a suitable workpiece. While many different alloys are possible, one suitable alloy contains the following components by weight percent:

Silicon 0.40–0.80
Iron 0.70
Copper 0.15–0.40
Manganese 0.15
Magnesium 0.80–1.20
Chromium 0.04–0.35
Zinc 0.25
Titanium 0.15
Aluminum 97.36–96.00

Such alloy has high strength (Ultimate Tensile Strength of 42,000 PSI; Yield Strength, Tension of 35,000 PSI), is corrosion and acid resistant, and has good extrusion properties. The dimensions of the billet may be varied to suit the desired dimensions of the workpiece after extrusion.

Step 2 of the process comprises heating the billet to a temperature which renders it in a "plastic" state, in which it will deform non-elastically without rupture. Such temperature is sufficiently high to render the billet malleable (and thus readily extrudable), yet is substantially below the melting point of the metal. In an aluminum alloy of the composition set forth above, this desired temperature (designated in the trade as the "solid form" or "W-Temper" temperature) may be on the order of 700° F., where the melting point of the alloy may be on the order of 1200° F. Heating the billet to the W-Temper temperature renders it amenable to extrusion, but avoids inclusions of gas bubbles and the like that tend to be incorporated into a casting wherein the metal is melted to a liquid state.

Step 3 of the process comprises loading the billet into an extrusion press assembly of one of several types well known in the art. Such extrusion presses provide a billet holder, a die, a ram to force the plasticized metal billet through the die, and means to hold the die in place for forcing the metal therethrough. The extrusion press may also comprise a cylindrical mandrel, which may be attached to the ram or to the die, for forming the central bore of the workpiece upon extrusion.

Figure 2:
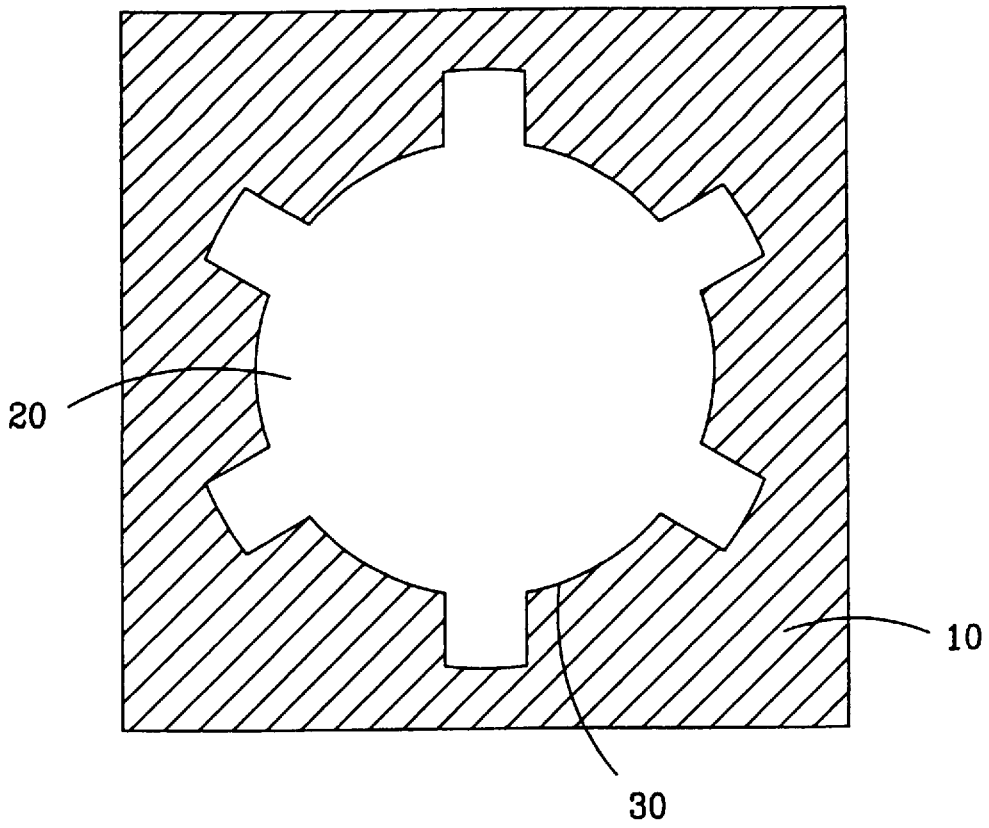
FIG. 2 is a schematic of a typical extrusion die used in forming the centralizer of the present invention.

Step 4 is the forcing of the billet through the suitable die. After loading of the billet in Step 3, with a suitable die in place, the ram of the extrusion press is advanced so as to force the plasticized billet through the die, thus forming a workpiece substantially free of inclusions, and having a length in excess of the desired length of a casing centralizer. The die has a profile suitable for forming the desired cross sectional shape of the workpiece, and ultimately the casing centralizer. While many different shapes are possible, FIG. 2 shows the shape of one die which forms an embodiment of the casing centralizer of the present invention. It is to be noted that the illustrated die results in the desired outer or circumferential profile of the casing centralizer; the bore of the centralizer may be formed in different ways. A billet having a bore with a diameter adapted to fit closely about the outer surface of a casing string may be used. Alternatively, when solid billets are used, an inner, circular spear-shaped mandrel may be attached to the ram of the extrusion press to first pierce the billet. Once the mandrel has completed penetrated the billet and is positioned substantially centrally within the die opening, extrusion begins through the die, with the plasticized metal flowing around the mandrel forming the bore. In such cases, the mandrel has an outer diameter corresponding substantially to the desired bore diameter of the centralizer. Other die/mandrel combinations well known in the art may be employed, such as dies having mandrels fixed in place just upstream from the die.

The surface finish of the extruded workpiece is very smooth and requires no additional finish work to be suitable for the centralizer of the present invention. Surface finish depends on a number of factors, including the alloy used and the rate of extrusion. By way of example only, an overall typical surface finish obtained by the extrusion process of the present invention has an RMS (Root Mean Square) roughness value, as measured by techniques known in the art, of approximately 125 micro inches. This finish is much smoother than that obtainable in a sand casting process. Increasing smoothness is indicated by a decreasing RMS value. Typical sand casting surface finish RMS values are 400 to 500 micro inches.

Once extruded from the die, Step 5 of the process comprises transferring the workpiece to a handling means which moves the workpiece away from the press, which may comprise a moving conveyor belt or other means.

Step 6 comprises a controlled cooling of the extruded workpiece to a temperature at which further handling of the workpiece is possible. Cooling may be done by various means known in the art, including forced air, liquid quenching, or other techniques. The cooling process is controlled as appropriate to retain the strength of the metal alloy.

Step 7 comprises cutting the workpiece into sections, with each section having a length suitable for forming a finished casing centralizer. Typically, the workpiece would be of sufficient length to form several centralizers. Cutting may be done with a saw, torch, or other suitable means known in the art. The final step, Step 8, comprises finish work which may be done to the centralizer after cutting to length. Such work may include bevelling the ends of the centralizer blades and drilling and threading of lock screw holes and insertion of lock screws.

It is to be understood that the above-described method of producing a centralizer of the present invention is but one embodiment of the present invention, and is not intended to represent the exclusive division of the overall process into the various steps, but rather as illustrative only. For example, certain of the various steps might be combined into a single "step", or sub-divided into a greater number of steps.

FIG. 2 is a schematic of a typical die employed in producing one embodiment of the present invention. Die 10 has a central opening 20 and a cross-sectional shape defined by profile 30 corresponding to the desired cross-sectional profile of the outer circumference of the workpiece and ultimately the centralizer.

Figure 3:
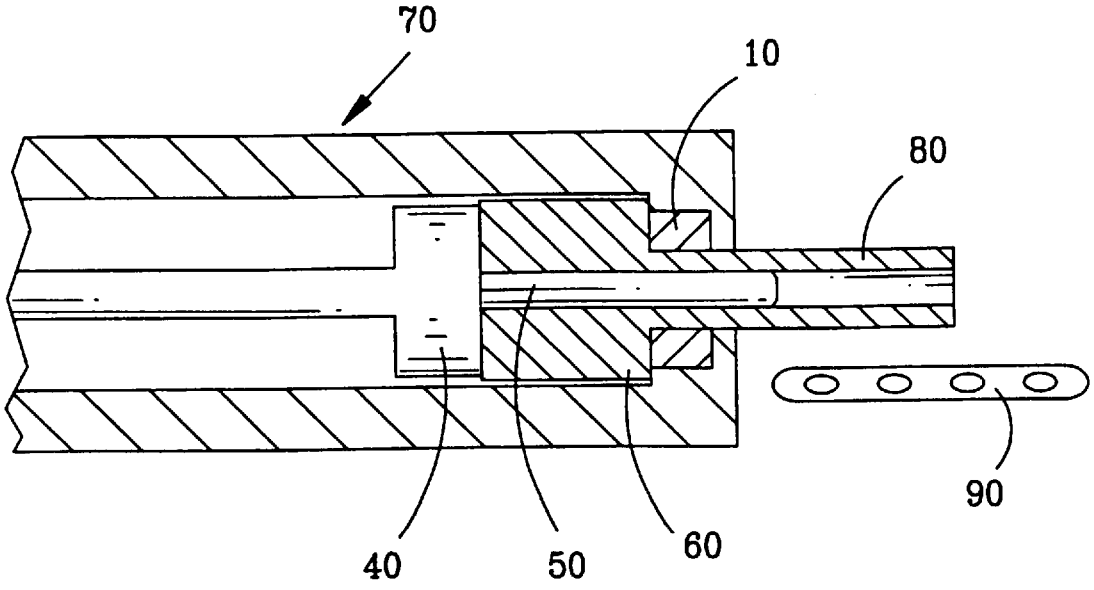
FIG. 3 is a cross section view of an extrusion press assembly during the extrusion process.

FIG. 3 is a schematic of one embodiment of a mandrel/die combination for producing the centralizer of the present invention, in position during the extrusion process, along with associated equipment for producing the workpiece. An extrusion press 70 has a ram 40 therein. Ram 40 has mandrel 50 attached to the forward face of ram 40. When using a solid billet, mandrel 50 is advanced so as to penetrate a billet 60, and during extrusion mandrel 50 is disposed centrally in central opening 20 of die 10. Mandrel 50 has a circular cross section with a diameter corresponding to the desired bore diameter of the extruded centralizer. Advancing ram 40 and mandrel 50 results in billet 60 being forced through die 10, forming a workpiece 80, which is moved away from extrusion press 70 by a handling means 90. In other embodiments, mandrel 50 may be fixed in a holder upstream of die 10 by means well known in the art.

Figure 4:
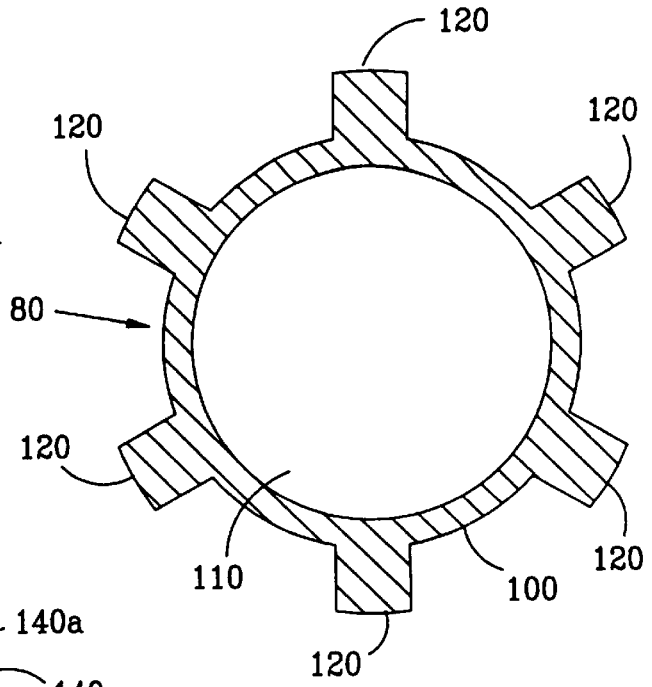
FIG. 4 is a cross section view showing a profile of a workpiece.

FIG. 4 is a cross-section view of workpiece 80. As is readily seen, workpiece 80 has a cross-sectional shape including an outer perimeter 100 as desired for the finished centralizer, and a bore 110 having a diameter adapted to closely engage a casing string. Workpiece 80 further has outward radiating blades 120, which ultimately form the blades of the finished centralizer, as will be more fully described herein.

Figure 5:
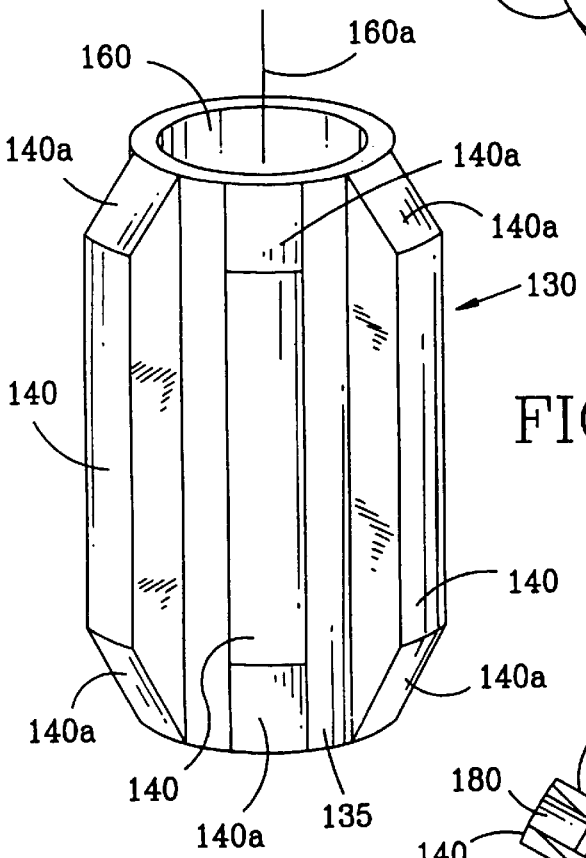
FIG. 5 is a perspective view of a centralizer according to the present invention.

FIG. 5 is a schematic of a centralizer 130 made from workpiece 80. Workpiece 80, being longer than a desired length of centralizer 130, is cut to a desired length of centralizer 130 by a saw, torch, or other suitable means. Centralizer 130 includes a central body 135 having integrally-formed blades 140 radiating outward therefrom. In the particular embodiment shown, centralizer 130 has six equally spaced-apart blades (some blades being hidden from view), but different numbers and spacing of blades are possible. Bevels 140*a* may be cut on both ends of each blade 140 to ease passage of centralizer 130 into and out of a well bore.

Figure 6:
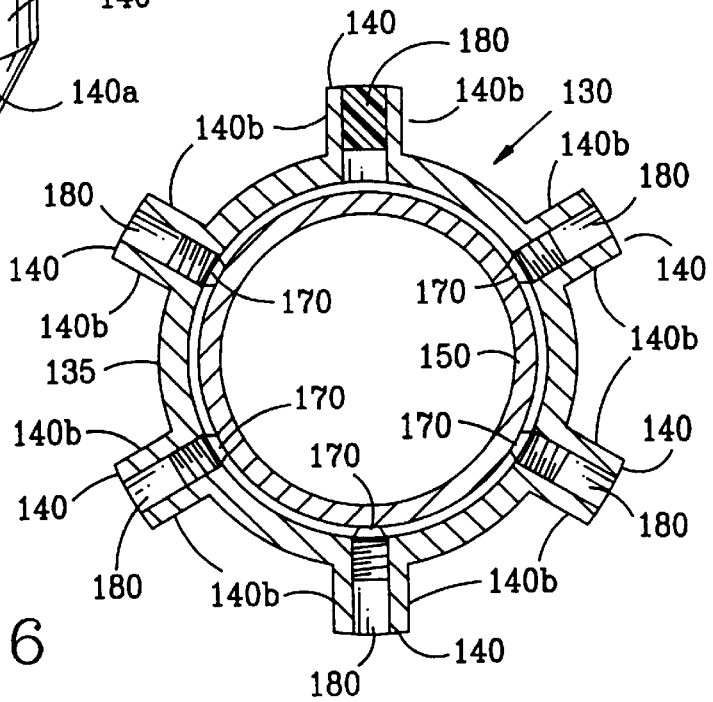
FIG. 6 is a cross section view of a centralizer fixed on a joint of casing.

FIG. 6 shows, in cross-section, centralizer 130 mounted on a casing string 150. Side walls 140*b* of each blade 140 may be substantially parallel to one another, as shown in FIG. 6. Alternatively, each side wall 140*b* may form an acute angle with respect to a line radially bisecting blade 140, designated by angle A in FIG. 7, being a close-up cross-section view of blade 140. With the extrusion process of the present invention, centralizers may be made having angle A ranging between zero (or parallel sidewalls) and angles approaching ninety degrees. Centralizer 130 has bore 160 permitting centralizer 70 to be placed over casing string 150 and secured in place. Bore 160 has a central longitudinal axis 160*a* therethrough, best seen in FIG. 5.

As seen in FIG. 6, centralizer 130 may be secured in position on a casing string 150 by set screws 170 engaged in threaded holes 180 and bearing against casing string 150. Other means of securing centralizer 130 well known in the art may be used, such as locking bands or clamps placed above and below on a casing string above and below centralizer 130. In other cases, centralizer 130 may simply be permitted to travel freely along a joint of casing between adjacent casing couplings or "collars".

Figure 7:
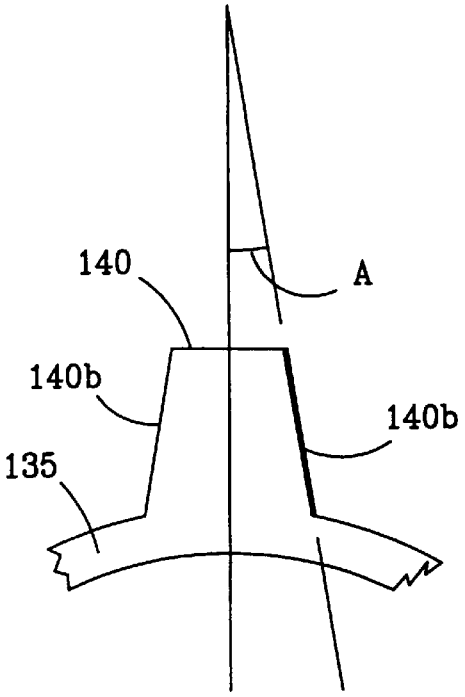
FIG. 7 is a close up view of a centralizer blade.
Figure 7A:
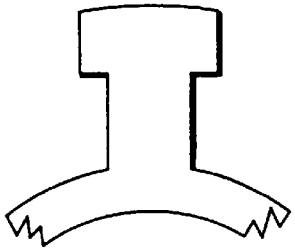
FIGS. 7A, 7B, 7C, and 7D are cross section views of different embodiments of centralizer blades.
Figure 7C:
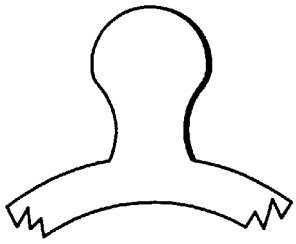
Figure 7B:
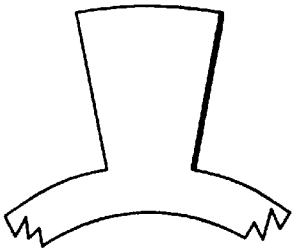
Figure 7D:
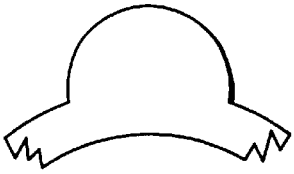

Other cross-sectional shapes of blades 140 are possible, to yield a desired combination of annular flow area and bearing surface (that being the surface area bearing against the borehole or next-larger casing string). In FIGS. 7A, 7B, 7C, and 7D, several possible profiles of blades 140 are shown, without limitation comprising a T-shape as shown in FIG. 7A, a dovetail shape as shown in FIG. 7B wherein the cross-section width of the blade increases in a direction away from the central body, a "half-dumbbell" shape comprising a base proximal to central body 135, a narrower stem, and an expanded bulbous section distal from central body 135 as shown in FIG. 7C, or a half-circle as shown in FIG. 7D.

Figure 8:
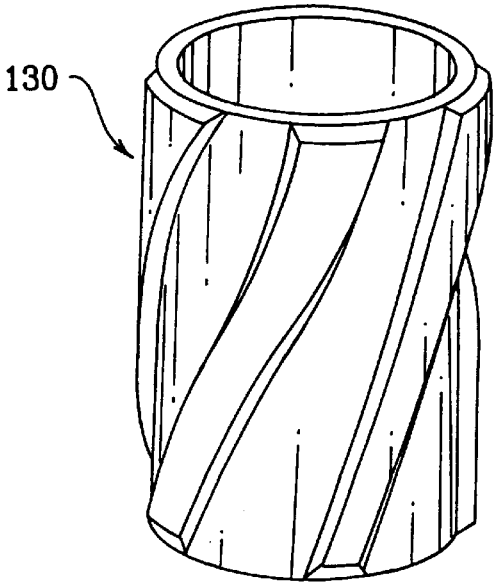
FIG. 8 is a view of another embodiment of the centralizer of the present invention.

Other embodiments of the present invention include a casing centralizer 130 formed by the described extrusion process, having blades 140 which are not parallel with a central longitudinal axis 160*a*, but rather "spiral" at least partially around central body 135, as shown in FIG. 8. Different number of blades and spacing thereof are possible.

To use the centralizer of the present invention to centralize casing in a well, a typical method is to commence running the casing in the well, stopping at the first joint upon which a centralizer is to be attached. Such first joint is then lowered through a centralizer, and the casing connection made up. The casing string is then lowered downhole until the centralizer can be slid to the desired attachment point on the joint of casing, and the set screws (or other attachment means) employed to fix it in place. This process is repeated to fix centralizers at desired locations on the casing string as the string is made up and run in the hole.

By the foregoing description, it may be seen that an extruded workpiece is formed having a cross-sectional shape as desired for a casing centralizer, then cut to desired lengths and finished to form completed centralizers. Such process results in a solid, integrally formed casing centralizer having the advantages of:

- being substantially free of inclusions, gas bubbles, or other defects, thereby achieving the requisite strength with an overall smaller cross-sectional area;
- a cross-sectional area and profile generally optimized for strength and retention of maximum annular flow area between the casing string and the borehole;
- a very smooth surface finish, with an overall surface finish RMS value of approximately 125 micro inches;
- avoiding the environmental concerns associated with disposal of sand casting materials;
- the capability of utilizing relatively low cost alloys;
- production in longer lengths than is possible with castings, where multiple shorter centralizers must be linked together to form a long unitary centralizer;
- significant cost savings through reduced labor, reduced poundage of metal, and lower unit cost alloys.

Although the description above contains many specificities, these should not be construed as limiting the scope of the invention but as merely providing illustrations of some of the presently preferred embodiments of this invention. For example, the blades may extend substantially the full length of the central body, or only a part of the length; different numbers of blades may be used, along with non-uniform spacing about the circumference of the centralizer, if desired; the blades may run substantially parallel to the central longitudinal axis of the central body bore, or may spiral partly around the central body; different metal alloys may be used, including but not limited to those comprising aluminum, bronze, and/or zinc; different forms of lock means may be provided; the centralizer may be used on different types of tubular strings, including production tubing and the like, etc. Further, the centralizer may be formed from non-metallic composite materials, such as plastics, reinforced plastics, phenolic resins, and the like.

Thus the scope of the invention should be determined by the appended claims and their legal equivalents, rather than by the examples given.

I claim:

1. An integrally formed, solid casing centralizer, comprising:

a) a central body having a bore therethrough, said bore having a central longitudinal axis and a diameter adapted to closely engage an outer surface of a casing;

b) a plurality of blades integral to and radiating outwardly from said central body, said central body and said blades forming a desired cross-sectional shape of said centralizer in a plane perpendicular to said central longitudinal axis of said bore, said central body and said blades integrally formed by heating a billet of material to a temperature sufficient to render said billet malleable yet which is substantially below a melting temperature of said billet and thereafter forcing said billet through a die, said die having a suitable profile for forming said desired cross-sectional shape of said centralizer, said billet after forcing through said die forming a workpiece substantially free of inclusions and having said desired cross-sectional shape of said centralizer, cooling said workpiece, and cutting said workpiece to a length suitable for forming said centralizer.

2. The centralizer of claim 1, wherein said billet is of a non-ferrous metal alloy.

3. The centralizer of claim 2, wherein said blades are in substantially equally spaced apart relation and run substantially parallel to said central longitudinal axis of said bore.

4. The centralizer of claim 3, further comprising at least one set screw extending threadedly through at least one hole in at least one of said blades and said central body.

5. The centralizer of claim 4, wherein each blade has opposite ends tapering outwardly toward one another.

6. The centralizer of claim 1, wherein at least one of said blades spirals at least partially about a circumference of said central body.

7. The centralizer of claim 1, wherein said billet is of a ferrous metal alloy.

8. The centralizer of claim 1, wherein said billet is of a non-metallic material.

9. The centralizer of claim 1, wherein each blade has sidewalls, and on at least one of said blades an angle between one of said sidewalls and a line radially bisecting said blade is less than about forty-five degrees.

10. The centralizer of claim 1, wherein a cross-sectional shape of at least one of said blades comprises a T-shape.

11. The centralizer of claim 1, wherein a cross-sectional shape of at least one of said blades comprises a dovetail shape wherein a cross-sectional width of said blade increases in a direction away from said central body.

12. The centralizer of claim 1, wherein a cross-sectional shape of at least one of said blades comprises a half-dumbell shape having a base proximal to said central body, a narrowing stem, and an enlarged bulbous section distal from said central body.

13. The centralizer of claim 1, wherein a cross-sectional shape of at least one of said blades comprises a half-circle.

14. The centralizer of claim 1, wherein said workpiece after extrusion and cooling has an overall surface finish RMS value of less than 350 micro inches.

15. The centralizer of claim 1, wherein said workpiece after extrusion and cooling has an overall surface finish RMS value of less than 150 micro inches.

16. A solid casing centralizer, comprising:

a) a tubular central body adapted to closely fit about a joint of casing and having a central longitudinal axis therethrough;

b) a plurality of blades integral to said central body and spaced substantially equally around said central body, said central body and said blades forming a desired cross-sectional shape of said centralizer in a plane perpendicular to said central longitudinal axis, said central body and said blades integrally formed by heating a metal billet to a temperature sufficient to render said billet malleable yet which is substantially below a melting temperature of said billet and thereafter forcing said billet through a die, said billet after forcing through said die forming a metal workpiece substantially free of inclusions, having an overall surface finish RMS value of approximately 125 micro inches and having said desired cross-sectional shape of said centralizer, and cutting said workpiece to a desired centralizer length.

17. The centralizer of claim 16, wherein each blade has sidewalls, and on at least one of said blades an angle between one of said sidewalls and a line radially bisecting said blade is less than about forty five degrees.

18. A method of forming a casing centralizer having blades integral with a central body and substantially free of gas inclusions, comprising the steps of:

a) providing a metal billet comprising a suitable metal alloy;

b) heating said billet to a temperature sufficient to render said billet malleable yet which is substantially below a melting temperature of said billet;

c) forcing said billet through a die, said die having a suitable profile for forming a desired cross-sectional shape of said centralizer, said billet after forcing through said die forming a workpiece substantially free of gas inclusions and having said a desired cross-sectional shape for said centralizer but a length in excess of a desired finished length of said centralizer;

d) moving said workpiece away from said die as said workpiece is extruded;

e) cooling said workpiece, and f) cutting said workpiece to a desired length of said centralizer.

19. A method of centralizing a string of tubulars in a well, comprising the steps of:

a) providing a plurality of centralizers comprising a central body having a bore therethrough, said bore having a central longitudinal axis and a diameter adapted to closely engage an outer surface of a tubular, a plurality of blades integral to and radiating outwardly from said central body, said central body and said blades forming a desired cross-sectional shape of said centralizer in a plane perpendicular to said central longitudinal axis of said bore, said central body and said blades integrally formed by heating a billet of material to a temperature sufficient to render said billet malleable yet which is substantially below a melting temperature of said billet and thereafter forcing said billet through a die, said die having a suitable profile for forming said desired cross-sectional shape of said centralizer, said billet after forcing through said die forming a workpiece substantially free of inclusions and having said desired cross-sectional shape of said centralizer, cooling said workpiece, and cutting said workpiece to a length suitable for forming said centralizer;

b) running said string of tubulars into said well until a first desired centralizer point is reached;

c) attaching at least one of said centralizers about the outer surface of said string of tubulars at said first desired centralizer point; and d) running said string of tubulars into said wellbore to a desired depth, attaching at least one of said centralizers about said outer surface of said string of tubulars at desired spacing intervals.

* * * * *